US009593858B2

(12) United States Patent
Dellwig et al.

(10) Patent No.: US 9,593,858 B2
(45) Date of Patent: Mar. 14, 2017

(54) CONTROL DEVICE FOR A HEATING SYSTEM AND HEATING SYSTEM

(75) Inventors: Stefan Dellwig, Hamburg (DE); Johann Lipinski, Ahrensburg (DE)

(73) Assignee: UPONOR INNOVATION AB, Virsbo (SE)

( * ) Notice: Subject to any disclaimer, the term of this patent is extended or adjusted under 35 U.S.C. 154(b) by 1046 days.

(21) Appl. No.: 13/293,244

(22) Filed: Nov. 10, 2011

(65) Prior Publication Data

US 2012/0118556 A1 May 17, 2012

(30) Foreign Application Priority Data

Nov. 15, 2010 (DE) ..... 20 2010 015 516 U

(51) Int. Cl.
*F28F 27/00* (2006.01)
*F24D 19/10* (2006.01)
*F24D 3/08* (2006.01)

(52) U.S. Cl.
CPC ..... *F24D 19/1009* (2013.01); *F24D 3/08* (2013.01)

(58) Field of Classification Search
CPC ..... F24D 19/1009; F24D 3/08; E04C 1/392
USPC ..... 237/2 R, 8 A, 69; 165/53, 288
See application file for complete search history.

(56) References Cited

U.S. PATENT DOCUMENTS 2,115,706 A * 5/1938 Cornell, Jr. ..... 237/8 R
2,739,792 A * 3/1956 Blum ..... 237/8 R
2,784,945 A * 3/1957 Fodor ..... F24D 3/14 165/56
2,935,154 A * 5/1960 Kelley ..... F24F 3/1417 261/131
3,171,387 A * 3/1965 Muller ..... F24H 1/52 237/8 R (Continued)

FOREIGN PATENT DOCUMENTS

DE 2952758 7/1981
DE 202005005670 9/2005

(Continued)

OTHER PUBLICATIONS

KKW Kulmbacher Klimagerate, FR 2313640 A1 English machine translation, Dec. 31, 1976.*

(Continued)

*Primary Examiner* — Alissa Tompkins
*Assistant Examiner* — Phillip E Decker
(74) *Attorney, Agent, or Firm* — Occhiuti & Rohlicek LLP

(57) ABSTRACT

A control device for controlling a heating system having a first heat exchanger disposed in a first part of a building, and second heat exchanger disposed in a second part of a building, the control device comprising: a first temperature sensor associated with the first heat exchanger and measuring a temperature in the first part of the building, a second temperature sensor associated with the second heat exchanger and measuring a temperature in the second part of the building. The control device includes a control station by which a temperature compensation can be initiated by recirculating a fluid medium to be used for heat exchange as a function of the temperatures (T1, T2) measured by the first and the second temperature sensor and at least partial exchange of the fluid medium takes place between the first heat exchanger and the second heat exchanger.

16 Claims, 3 Drawing Sheets

(56) References Cited

U.S. PATENT DOCUMENTS

Figure 1:
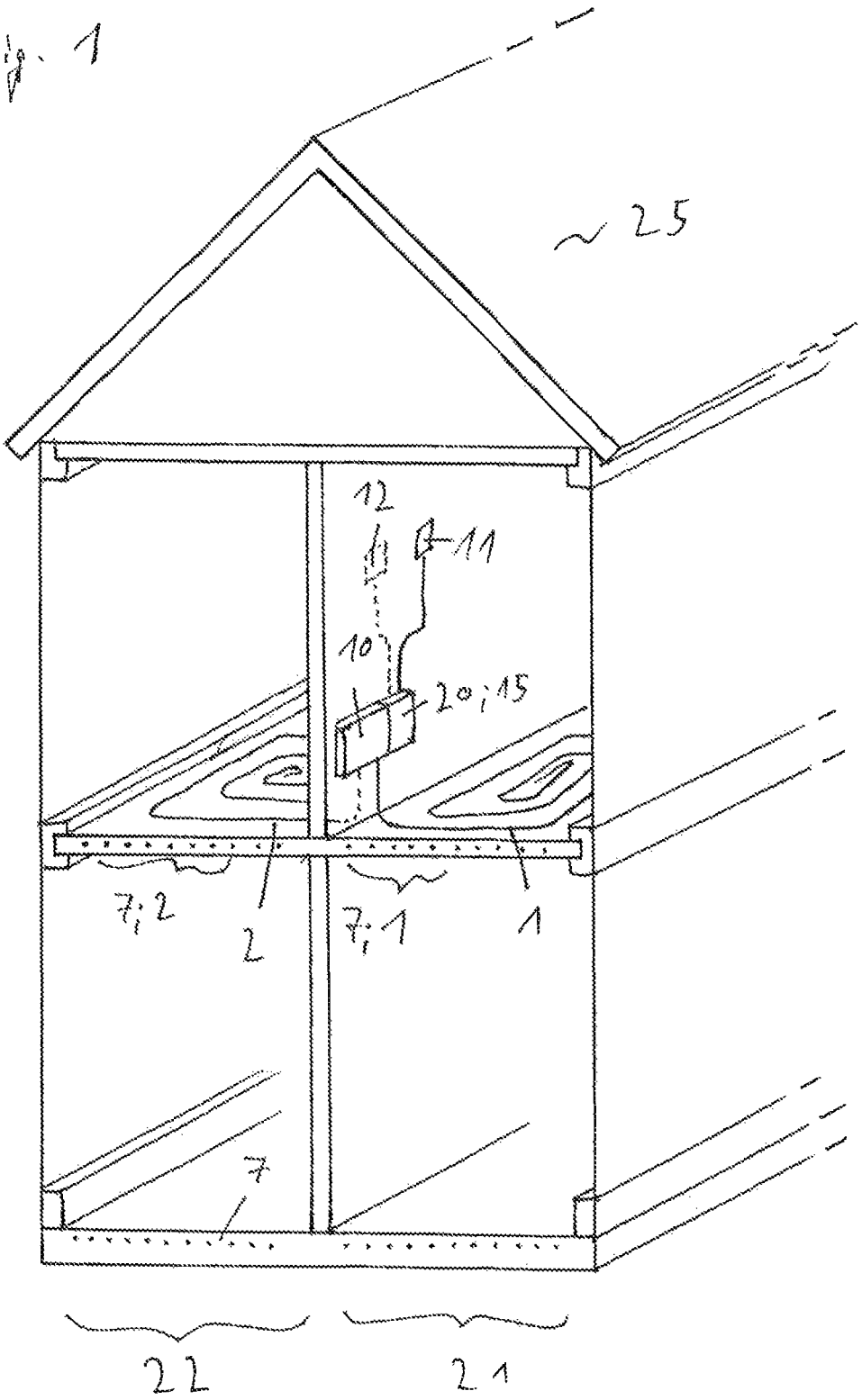

| | | | | |
|---|---|---|---|---|
| 3,181,604 | A * | 5/1965 | Kritzer | 165/50 |
| 3,227,208 | A * | 1/1966 | Potter, Jr. | A62B 7/06 165/299 |
| 4,206,874 | A * | 6/1980 | Semple | 237/8 C |
| 4,410,133 | A * | 10/1983 | Furukubo | F01P 7/165 236/100 |
| 4,907,739 | A * | 3/1990 | Drake | F24D 19/1009 237/8 C |
| 5,004,149 | A * | 4/1991 | Narikiyo | 165/217 |
| 5,183,102 | A * | 2/1993 | Clark | 165/50 |
| 5,586,449 | A * | 12/1996 | Krist | 237/8 R |
| 6,302,094 | B1 * | 10/2001 | Wehrly | F24H 1/187 126/204 |
| 6,644,398 | B2 * | 11/2003 | Bujak, Jr. | 237/2 R |
| 2004/0104277 | A1 * | 6/2004 | Walsh | F24F 11/008 236/12.1 |
| 2007/0000660 | A1 * | 1/2007 | Seerup | 165/296 |
| 2007/0108307 | A1 * | 5/2007 | Sinclaire | 237/69 |
| 2009/0255997 | A1 * | 10/2009 | Goldmann | 236/1 B |
| 2009/0314464 | A1 * | 12/2009 | Farrell | F24H 7/0466 237/69 |
| 2012/0168142 | A1 * | 7/2012 | Hernandez | F28D 1/0477 165/279 |
| 2013/0076033 | A1 * | 3/2013 | Zachary | F24D 5/04 290/2 |

FOREIGN PATENT DOCUMENTS

| | | | | |
|---|---|---|---|---|
| DE | 102009008801 | | 8/2010 | |
| EP | 0002839 | | 12/1978 | |
| FR | 2313640 | A1 * | 12/1976 | |
| GB | 2014297 | | 8/1979 | |
| JP | 2005155958 | A * | 6/2005 | |
| WO | WO 2009069892 | A2 * | 6/2009 | F24D 19/10 |
| WO | 2010/089027 | | 8/2010 | |

OTHER PUBLICATIONS

Langlotz, et al, DE 202005005670 U1 English machine translation, Sep. 8, 2005.*

Weiss, DE 2952758 A1 English machine translation, Jul. 23, 1981.*

* cited by examiner

CONTROL DEVICE FOR A HEATING SYSTEM AND HEATING SYSTEM

CROSS REFERENCE TO RELATED APPLICATIONS

This application claims the priority of German application no. 202010015516.9, filed Nov. 15, 2010, the contents of which are incorporated by reference.

The application relates to a control device for a heating system and further relates to a heating system provided with and controlled by a control device.

Frugal use of energy is critical to the economic efficiency of heating systems, particularly of heating systems for buildings. The room temperature is often regulated by means of controlled or regulated throttling of the fluid heating medium (heat exchange medium) being transported, such as water, that is fed into the radiators of each room, or in concrete slabs or other types of surface heating elements that form the walls, floors, and/or ceilings of the rooms.

The optimal flow rate of the fluid medium is often different in the various rooms of a building; it depends on the prescribed target temperature of the room (as a function of the time and day of the week), but also on the additional energy input or energy output due to sunlight, wind, soil temperature, manual or automatic ventilation, or other influences.

If a room is being heated but has ultimately reached and exceed its desired target temperature, the infeed of the fluid medium or its flow rate in the heating system of the room (or of its wall, ceiling, or floor) is conventionally throttled or interrupted. If this is not sufficient, then the room temperature can be decreased again by automatically ventilating the room. But even if the heated discharge air is recycled to recapture energy, then energy savings are limited. Particularly if heating is still performed in other rooms of the building, such on the north side or on the ground floor (that is the lowermost story above the ground) because the temperature there is below the provided target temperature, greater and more efficient energy savings would be desirable.

There is thus a need for a control device by means of which a heating system can be operated in a way saving even more energy and by means for which particularly local deviations from the target temperature in individual rooms or groups of rooms can be compensated for more quickly and efficiently.

The application provides a control device for controlling a heating system having at least one first heat exchanger disposed in a first part of a building, and at least one second heat exchanger disposed in a second part of a building.

wherein the control device comprises at least the following:

at least one first temperature sensor associated with the first heat exchanger and measuring a temperature in the first part of the building, at least one second temperature sensor associated with the second heat exchanger and measuring a temperature in the second part of the building, wherein the control device comprises a control station by which a temperature compensation can be initiated by simply recirculating a fluid medium to be used for heat exchange as a function of the temperatures measured by the first and the second temperature sensor, wherein an at least partial exchange of the fluid medium takes place between the first heat exchanger and the second heat exchanger. Preferably, a complete exchange of the fluid medium (streaming in and/or between the first and second heat exchangers) between the first heat exchanger and the second heat exchanger is effected, particularly by switching the first and the second heat exchanger in series with one another.

The control device according to the application uses the fluid medium not only for heating, but also for cooling. However, no active cooling is used; rather the fluid medium is exchanged between at rooms, groups of rooms, sides or other parts of buildings having different temperatures. The control device measures opposing deviations from the target temperature provided in the different parts of the building (like a temperature too high in first, overheated rooms of the building as opposed to a temperature too low in further, second subcooled rooms of the building) and uses the fluid medium itself to adjust the room temperature. To this end, the flow streams of the fluid medium are diverted, that is re-routed, in a way that differs from the flow scheme in conventional operation.

The control device or its control station adjusts the heating system which it is a part of, such that a closed circuit of the fluid medium is established between a first and a second heat exchanger each associated with different parts of the building, which may for instance be different rooms, different groups of rooms, different floors or stories, or different sides of the building. In case that the heat exchangers are associated with different, opposite sides of the building, each side of the two opposite sides of the building may comprise a room or a groups of rooms arranged at that respective side of the building and/or having windows at that respective side of the building). In the closed circuit established between the first and the second heat exchanger, the medium circulates between both heat exchangers but remains separated or cut off from any remaining quantity of fluid medium and from active heat input. In place of the first and second heat exchangers, groups of first or second heat exchangers can also be provided, leading into a plurality of overheated or subcooled rooms at the same time.

The circulating partial circuit arising from simple recirculation of the medium, cut off from the other heat exchangers of the arrangement of heat exchangers, is automatically initiated and maintained by the control device whenever and as long as the first part of the building is heated above its target temperature and the second part of the building at the same time is colder than its target temperature. Preferably this temperature compensation is initiated and executed at least when and/or as long as overheated rooms and other subcooled rooms are present in the same time in the building, and it is particularly initiated and executed between those rooms, groups of rooms, floors or sides of the building where the target temperature of the overheated rooms is greater than the target temperature of the subcooled rooms. The overheated rooms (excessively high temperature) is then cooled and the subcooled rooms are heated, exploiting merely the locally varying temperature of the fluid medium without consuming additional energy from a furnace, a heating or a cooling unit. Thereby temperature control can be effected merely by means of the continuous or intermittent recirculation of the fluid medium in the closed circuit between the first and the second heat exchanger. The local deviations from the target temperature in individual rooms or groups of rooms are thereby compensated for more quickly and efficiently, while saving more energy.

Preferably the first part of the building in which the at least one first heat exchanger is disposed comprises a first room, a first group of rooms, a first story, or a first side of a building, whereas the second part of the building in which the at least one second heat exchanger is disposed comprises another second room, another second group of rooms, another second story, or another second side of a building, respectively. Preferably the first part and the second part are opposed to one another. For instance, the first part may comprise all rooms constituting the south side or façade of the building whereas the second part may comprise all rooms constituting the north side or façade of the building. Alternatively, the first part may comprise rooms on upper floors or stories whereas the second part may comprise rooms on lower floors or stories of the building, for instance. Accordingly, according to the present application the first and second heat exchangers are arranged distant from one another and are particularly arranged in different, preferably opposite parts of a building. In particular, for each room only one single heat exchanger or group of heat exchangers is provided which is usable, at a time, either as the first or as the second heat exchanger, depending on whether the respective room is to be momentarily cooled or heated. Thus the control device comprises just one single heat exchanger or group of heat exchangers in each room, which heat exchanger or group of heat exchangers is usable either as the at least one first heat exchanger or, alternatively, as the at least one second heat exchanger at a time. Thus there is no need for installing both first and second heat exchangers one and the same room. Instead, the heat exchangers installed in it or in its walls, its floor and/or its ceiling or its radiators temporarily can serves as the at least one first heat exchanger and, at other times, can serve as the at least one second heat exchanger, depending on whether the room is overheated or subcooled and on whether there are other rooms in the building which at the same time are subcooled or overheated. This preferably applies to all rooms of the building. Accordingly, there is no need to install two types of heat exchangers for heating and cooling (especially not in one and the same wall); instead the control station (particularly its distributor and/or its mixing valves) controls which heat exchangers are connected with one another, particularly in series, and thus effects cooling of the first and heating of the second room merely by circulation of the fluid medium. All features and positions enumerated in this paragraph for the first and second heat exchangers preferably likewise apply to the first and second temperature sensors. For instance, the first or, alternatively, second temperature sensors are installed in (and measure the temperature of) the first or, alternatively, second part of the building as defined above.

The features mentioned herein above are now described in some exemplary embodiments with reference to the figures.

Figure 2:
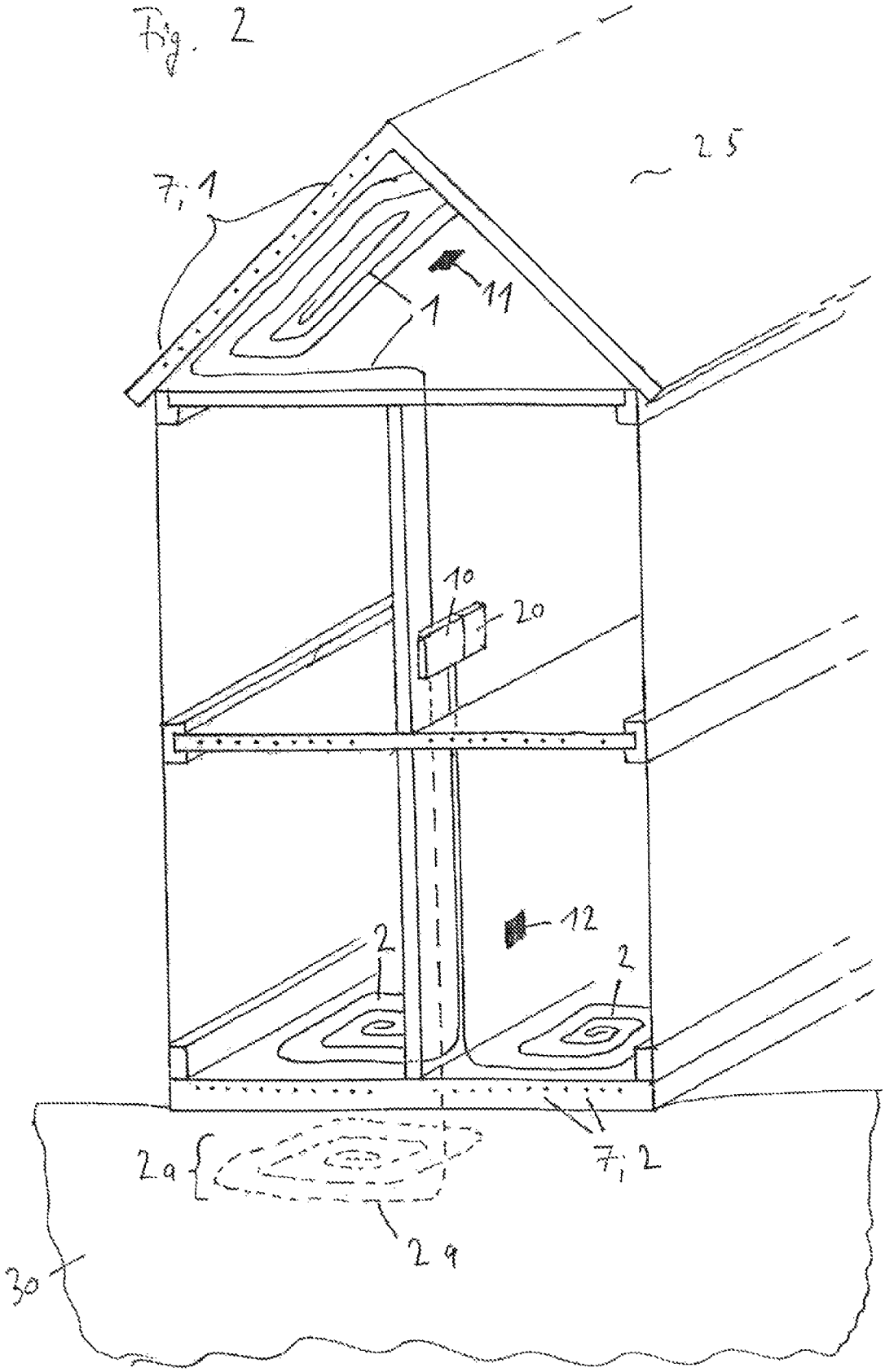
Figure 3:
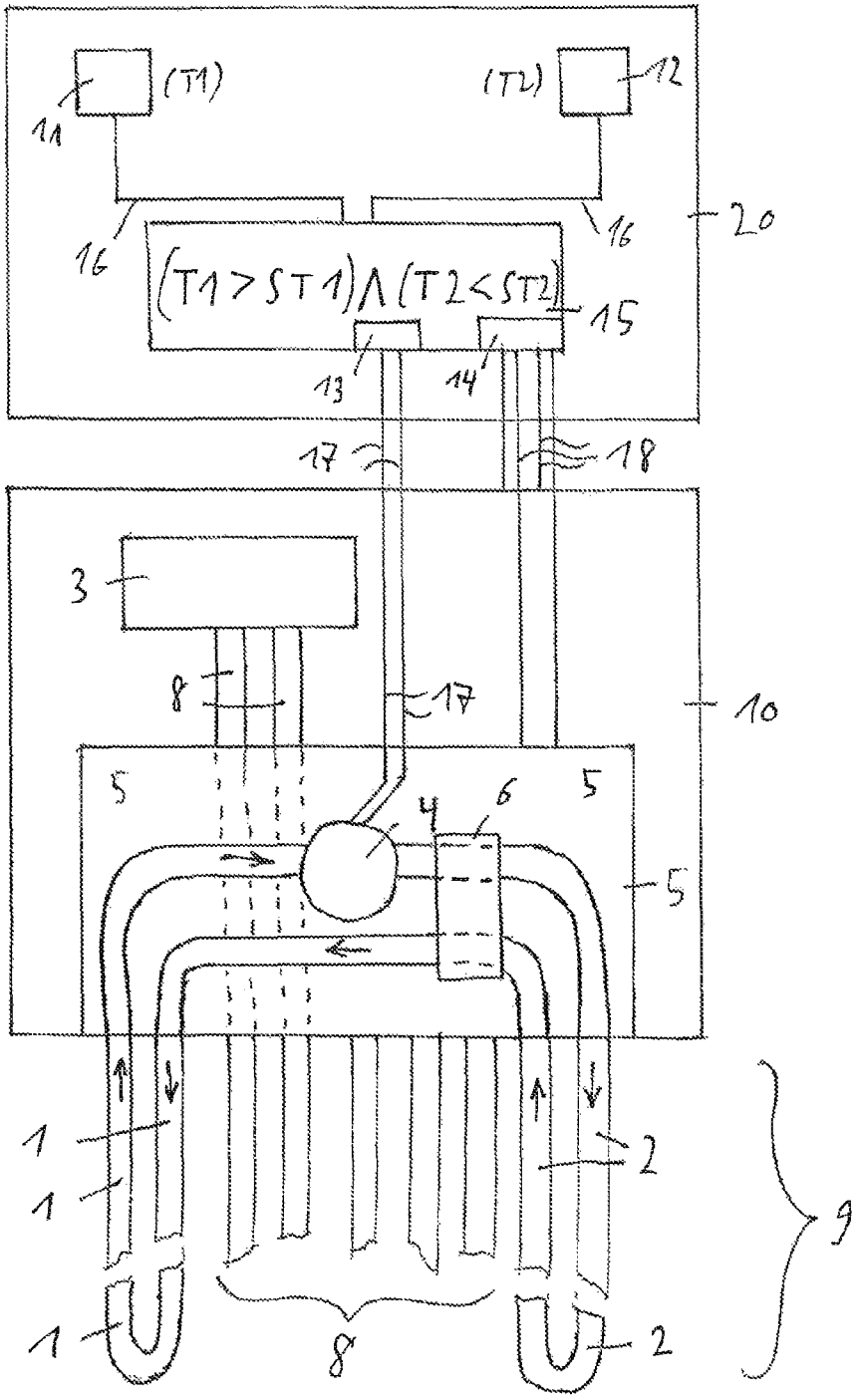

FIG. 1 shows a heating system and a control device according to a first embodiment in a building, FIG. 2 shows a heating system and a control device according to a second embodiment, and FIG. 3 shows a schematic representation of the control device and the heating system.

FIG. 1 shows a heating system 10 and a control device 20 according to a first embodiment, controlling the heating system 10. In this embodiment example, the rooms shown on the right in FIG. 1, for example, represent the rooms on the sunlit south side (first part of the building 21), while the rooms shown on the left in FIG. 1, for example, correspond to the cooler north side (second part of the building 22) of the building 25. Each of the building parts that can have separately controlled temperature can comprise a plurality of rooms, or just one room. The building 25 comprises surface heating elements 7, such as in the form of floors, ceilings, walls, or even the roof, permeated by heat exchanger lines. The heat exchangers 1, 2 disposed in the surface heating elements 7 (here the floors or ceilings) are indicated by spiral shapes and further shown as dashed lines in the section plane; they are connected to the heating system 10, which can be disposed at an arbitrary location in the building and which is shown only schematically, as is the control device 20. In both parts of the building, at least one temperature sensor 11, 12 is disposed; the first temperature sensor 11 measures the time dependent actual temperature T1 in the first part of the building 21 and the second temperature sensor 12 measures the temperature T2 in the second part of the building 22. Both sensors are connected to the control device 20 by connecting lines or in some other manner. The control device 20 compares each of the current temperatures T1, T2 to the target temperature ST1, ST2 for each room or part of the building, and particularly checks whether the actual temperature T1 exceeds the first target temperature ST1 in the first part of the building 21. It further checks whether the actual temperature T2 in the second part of the building 22 is lower than the second target temperature ST2. Finally, the control device 20 also checks whether both events occur at the same time. If this is the case, that is, if and as long as both the condition T1>ST1 and the condition T2<ST2 are met, the control device 20 initiates the heating system 10 to produce a closed circuit between the first 1 and the second heat exchanger 2, separated from the other heat exchangers of the arrangement of heat exchangers, and decoupled from further heat input from a heat source, such as a furnace of the heating system 10. The control device 20 further activates the circulating pump of the heating system 10, whereupon the medium circulates in the closed circuit formed by the first heat exchanger 1 and the second heat exchanger 2 (and optionally short connecting lines in the distributor). This results in an exchange of the fluid heat exchanger medium between both heat exchangers 1, 2, wherein the warmer medium from the first heat exchanger 1 is pumped into the second heat exchanger 2, and in turn the cooler medium is pumped from the second heat exchanger 2 into the first heat exchanger 1. In this embodiment example, it is assumed that the first target temperature ST1 is at least as high as the second target temperature ST2, so that each of the temperatures in the two rooms or parts of the building 21, 22 approach the corresponding target temperatures ST1, ST2 again. The rooms on the south side are thereby cooled and the rooms on the north side are heated, simply by circulating water or some other fluid medium in the heating system, without additional heating energy being consumed in the furnace or heating source. The first and the second heat exchanger 1, 2 can each also be a group of first and second heat exchangers 1, 2. The embodiment according to FIG. 1 can further be combined with that according to FIG. 2.

FIG. 2 shows a heating system 10 and a control device 20 according to a second embodiment, controlling the heating system 10. In the example of FIG. 2, the first heat exchanger 1 or the group of first heat exchangers 1 leads to the roof of the building 25. The second heat exchanger 2 or the group of second heat exchangers 2 leads to the floor of a lower story, or, as indicated by a first heat exchanger 2*a* shown in dashed lines, is located within a basement of the building (not shown) which may be provided beneath a floor slab of the ground story. First and second temperature sensors 11, 12 connected to the control device 20 (not shown) are further indicated.

The heating system 10 and the control device 20 function as in FIG. 1, with the difference that in FIG. 2 a temperature compensation takes place between two parts of the building at different heights in or on the building. Using the closed circuit between the first 1 and the second heat exchanger 2, for example, the roof story on which the sun shines is cooled during the day, and the lowest story is heated as soon as the temperature T1 on the roof has risen above the first local target temperature ST1 (T1>ST1) and the temperature T2 at the ground story is simultaneously lower than the lower local target temperature ST2 (T2<ST2).

FIG. 3 shows a schematic representation of an embodiment example of the control device 20 and the heating system 10, by means of which, for example, the temperature in the rooms of the building of FIGS. 1 and 2 can be controlled. The control device 20 measures the temperatures in at least two parts of the building by means of the temperature sensors 11, 12. The control device 20 or its control station 15 checks whether the temperature T1 in a first 21 of the building parts is above the target value ST1 set for this part of the building 21. A corresponding check is made as to whether the temperature T2 in the second part of the building is below the target temperature ST2 there. If and as long as both criteria are met, the control device 20 or its control station 15 initiates the closed circuit of the fluid medium in the first and second heat exchanger 1, 2, in that the distributor 5 is initiated to separate these heat exchangers 1, 2 from the remaining heat exchangers 8 of the arrangement of heat exchangers 9 and also from the heating source 3 or the furnace. This is done by means of the schematically represented switching elements (14) and/or actuating lines 18, or in another manner, such as actuators or the like. A mixer valve 6 or a group of mixer valves 6 can thus be set. The circulating pump 4 is further switched on and maintained in operation by means of schematically represented switching elements 13 and/or activation lines 17, so that the fluid medium contained in the heat exchangers 1, 2 can circulate therein. The surface heating elements 7 having heat exchangers 1, 2 (FIG. 1 or 2) thereby adapt their temperatures, leading to the actual room temperature T1, T2 approaching each target temperature. As soon as the temperature in even one of the two rooms or building parts 21, 22 is brought or returned to the local target temperature, the control device 20 or its control station 15 initiates the termination of the circulating closed circuit formed by the heat exchangers 1, 2 and sets the heating system 10 and the distributor 5 back to the original or previous operating settings.

REFERENCE LIST

1 First heat exchanger
2; 2*a* Second heat exchanger
3 Heating source
4 Circulating pump
5 Distributor
6 Mixing valve
7 Surface heating element
8 Remaining heat exchangers
9 Arrangement of heat exchangers
10 Heating system
11 First temperature sensor
12 Second temperature sensor
13, 14 Switching element
15 Control station
16 Connecting line
17 Activation line
18 Actuation line
19 Control device
20 First part of the building
21 Second, part of the building
25 Building
30 Ground
ST1 ST2 Target temperature
T1, T2 Temperature

The invention claimed is:

1. A control device for controlling a heating system, the control device comprising:

at least one first heat exchanger disposed in a first room of a building, and at least one second heat exchanger disposed in a second room of a building, and an active heat input capable of being in communication with the at least one first heat exchanger and the at least one second heat exchanger, at least one first temperature sensor associated with the first heat exchanger and measuring a temperature in the first room, at least one second temperature sensor associated with the second heat exchanger and measuring a temperature in the second room, an electronic control station which automatically initiates a temperature compensation by recirculating a fluid medium to be used for heat exchange depending on the temperatures measured by the first and the second temperature sensors, wherein an at least partial exchange of the fluid medium takes place between the first heat exchanger and the second heat exchanger; and wherein the electronic control station is implemented so that it produces a closed partial circuit only between the first heat exchanger and the second heat exchanger, wherein the first heat exchanger is connected in series to the second heat exchanger, for circulating the fluid medium carried in the first and the second heat exchangers only between the first and the second heat exchangers and remains cut off from the remaining fluid medium and from the active heat input;

wherein the fluid medium, in the closed circuit between the first heat exchanger and the second heat exchanger, is alternately passing through the first heat exchanger and the second heat exchanger.

2. The control device according to claim 1, wherein the electronic control station is implemented for always automatically initiating and/or maintaining a circulating circuit between the first heat exchanger and the second heat exchanger whenever the temperature in the first room is greater than a first target temperature prescribed for the first room and at the same time the temperature in the second room is less than a second target temperature prescribed for the second room, wherein the second target temperature is less than or equal to the first target temperature.

3. The control device according to the claim 1, comprising switching elements for switching on and off a circulating pump and a mixing valve provided at a heat source, at the control station, or at a distributor, wherein the electronic control station, in order to initiate the temperature compensation by circulation, uses the switching-elements to set the mixing valve to a closed circuit between the first and the second heat exchanger and to switch on the circulating pump.

4. The control device according to the claim 1, wherein the at least one first temperature sensor and the at least one second temperature sensor are disposed on the same story but on different sides of a building.

5. The control device according to the claim 4, wherein the at least one first temperature sensor and the at least one second temperature sensor are disposed in rooms on the same story but on opposite sides of the building.

6. The control device according to the claim 1, wherein the at least one first temperature sensor is disposed in an upper story, in a roof or in an attic of a building, whereas the at least one second temperature sensor is disposed in a lower story or in a basement of the building.

7. The control device according to the claim 1, wherein the electronic control station is connected to a distributor.

8. The control device according to the claim 7, wherein the electronic control station is connected upstream of the distributor.

9. The control device according to the claim 1, wherein the control device compares the temperature measured in the first room and the temperature measured in the second room with target temperatures and determines whether they are both either above or below their respective target temperatures at the same time, and if they are the electronic control station is implemented so that it produces a closed partial circuit between the first heat exchanger and the second heat exchanger.

10. The control device according to the claim 1, wherein the active heat input is used for heating only and the fluid medium is capable of heating and cooling.

11. The control device according to the claim 1, further including a circulating pump to circulate the fluid medium.

12. A heating system for a building, comprising at least the following:

an arrangement of heat exchangers, the arrangement comprising at least one first heat exchanger disposed in a first room of the building and at least one second heat exchanger disposed in a second room of the building, a heating source for heating a fluid medium of the heating system used for heat exchange, a circulating pump for circulating the fluid medium in the heating system, at least one distributor for distributing the fluid medium within the heating system, wherein the heating system comprises a control device including:

at least one first temperature sensor associated with the first heat exchanger and measuring a temperature in the first room, at least one second temperature sensor associated with the second heat exchanger and measuring a temperature in the second room, an electronic control station which automatically initiates a temperature compensation by recirculating a fluid medium to be used for heat exchange depending on the temperatures measured by the first and the second temperature sensors, wherein an at least partial exchange of the fluid medium takes place between the first heat exchanger and the second heat exchanger; and wherein the electronic control station is implemented so that it produces a closed partial circuit only between the first heat exchanger and the second heat exchanger, wherein the first heat exchanger is connected in series to the second heat exchanger, for circulating the fluid medium carried in the first and the second heat exchanger only between the first and the second heat exchanger and remains cut off from the remaining fluid medium, from the heating source, and from the arrangement of heat exchangers, except the first and second heat exchangers;

wherein the fluid medium, in the closed circuit between the first heat exchanger and the second heat exchanger, is alternately passing through the first heat exchanger and the second heat exchanger.

13. The heating system according to claim 12, wherein the at least one first heat exchanger and the at least one second heat exchanger each comprise one or more heat exchangers installed in concrete slabs or in other surface heating elements.

14. The heating system according to claim 12, wherein the at least one first heat exchanger and the at least one second heat exchanger are disposed in the same story of a building, but in rooms on opposite sides of the building, or at different heights, including a roof, an attic or a basement of the building.

15. A control device for controlling a heating system, the control device comprising:

an arrangement of heat exchangers including at least a first heat exchanger disposed in a first room of a building and a second heat exchanger disposed in a second room of a building, the heating system including a distributor for distributing a fluid medium to the arrangement of heat exchangers and a heating source connected to the distributor for heating the fluid medium of the heating system, the control device including:

at least one first temperature sensor associated with the first heat exchanger and measuring a temperature in the first room, at least one second temperature sensor associated with the second heat exchanger and measuring a temperature in the second room, and an electronic control station configured to automatically separate the first and second heat exchangers from the other heat exchangers in the arrangement of heat exchangers and from the heating source, based on the temperatures measured by the first and the second temperature sensors, the electronic control station further configured to automatically produce a closed circuit in which the fluid medium carried in the first and the second heat exchangers circulates in-series between the first and the second heat exchangers and remains cut off from the remaining fluid medium in the heating system, from the arrangement of heat exchangers, except the first and second heat exchangers, and from the heating source;

wherein the fluid medium, in the closed circuit between the first heat exchanger and the second heat exchanger, is alternately passing through the first heat exchanger and the second heat exchanger.

16. A heating system for a building, comprising at least the following:

an arrangement of heat exchangers, the arrangement comprising at least one first heat exchanger disposed in a first room of the building and at least one second heat exchanger disposed in a second room of the building, a heating source for heating a fluid medium of the heating system used for heat exchange, a circulating pump for circulating the fluid medium in the heating system, at least one distributor for distributing the fluid medium within the heating system, and a control device, including:

at least one first temperature sensor associated with the first heat exchanger and measuring a temperature in the first room, at least one second temperature sensor associated with the second heat exchanger and measuring a temperature in the second room, and an electronic control station configured to automatically separate the first and second heat exchangers from the other heat exchangers in the arrangement of heat exchangers and from the heating source, based on the temperatures measured by the first and the second temperature sensor, the electronic control station further configured to automatically produce a closed circuit in which the fluid medium carried in the first and the second heat exchangers circulates in-series between the first and the second heat exchangers and remains cut off from the remaining fluid medium in the heating system, from the arrangement of heat exchangers, except the first and second heat exchangers, and from the heating source;

wherein the fluid medium, in the closed circuit between the first heat exchanger and the second heat exchanger, is alternately passing through the first heat exchanger and the second heat exchanger.

* * * * *